US009806472B2

(12) United States Patent
Hsu et al.

(10) Patent No.: US 9,806,472 B2
(45) Date of Patent: Oct. 31, 2017

(54) ELECTRICAL CONNECTOR HAVING IMPROVED LED

(71) Applicant: FOXCONN INTERCONNECT TECHNOLOGY LIMITED, Grand Cayman (KY)

(72) Inventors: Chih-Ching Hsu, New Taipei (TW); Jun-Hua Hu, Kunshan (CN); Zhi Lu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/287,756

(22) Filed: Oct. 7, 2016

(65) Prior Publication Data

US 2017/0104298 A1 Apr. 13, 2017

(30) Foreign Application Priority Data

Oct. 7, 2015 (CN) ..... 2015 2 0768288 U

(51) Int. Cl.
*H01R 13/717* (2006.01)
*H01R 13/66* (2006.01)
(Continued)

(52) U.S. Cl.
CPC ..... *H01R 13/7175* (2013.01); *H01R 13/665* (2013.01); *H01R 24/64* (2013.01); *H01R 13/506* (2013.01)

(58) Field of Classification Search
CPC ..... H01R 24/64; H01R 13/7175
See application file for complete search history.

(56) References Cited

U.S. PATENT DOCUMENTS 6,102,741 A * 8/2000 Boutros ..... H01R 13/6633 439/676
6,478,611 B1 * 11/2002 Hyland ..... H01R 13/717 439/490

(Continued)

FOREIGN PATENT DOCUMENTS

| | | |
|---|---|---|
| CN | 2682686 | 3/2005 |
| CN | 102055121 | 11/2012 |
| CN | 203813146 | 9/2014 |

*Primary Examiner* — Briggitte R Hammond
(74) *Attorney, Agent, or Firm* — Wei Te Chung; Ming Chieh Chang

(57) ABSTRACT

An electrical connector includes: an insulative housing including a mating face, a mating cavity extending through the mating face in a front-to-rear direction, and a pair of light receiving slots situated above the mating cavity and extending through the mating face in the front-to-rear direction; a pair of light emitting diodes (LEDs) each mounted in a corresponding light receiving slot, each LED having a lighting portion and a pair of leads extending rearwardly from the lighting portion; and an adapting terminal module including an insulative body mounted on a rear side of the insulative housing and four adapting terminals retained to the insulative body, each adapting terminal having a cooperating portion interference fit with the lead; wherein the cooperating portion is resiliently connected with the lead of the LED, the insulative body includes a retaining post, and the lead is retained between the retaining post and the cooperating portion.

16 Claims, 5 Drawing Sheets

(51) Int. Cl.
*H01R 24/64* (2011.01)
*H01R 13/506* (2006.01)

(56) References Cited

U.S. PATENT DOCUMENTS

| | | | | |
|---|---|---|---|---|
| 6,655,988 | B1 | 12/2003 | Simmons et al. | |
| 6,688,909 | B1 | 2/2004 | Espenshade et al. | |
| 6,736,673 | B1 | 5/2004 | Simmons et al. | |
| 6,910,917 | B2 * | 6/2005 | Chen | H01R 13/518 439/490 |
| 7,125,280 | B1 * | 10/2006 | Lee | H01R 13/717 439/490 |
| 8,215,982 | B2 * | 7/2012 | Bu | H01R 13/518 439/541.5 |
| 9,397,450 | B1 | 7/2016 | Feng et al. | |
| 2008/0311798 | A1 * | 12/2008 | Wang | H01R 13/26 439/676 |

* cited by examiner

ELECTRICAL CONNECTOR HAVING IMPROVED LED

BACKGROUND OF THE INVENTION

1. Field of the Invention

The present invention relates to an electrical connector, and in particular to an electrical connector having an improved arrangement of light emitting diode (LED).

2. Description of Related Art

China Patent No. 203813146, issued on Sep. 3, 2014, discloses an electrical connector including an LED. The LED includes a lighting portion and a pair of leads extending rearwards from the lighting portion. An adapting terminal module includes plural terminals each having a soldering surface for soldering to the lead.

U.S. Pat. No. 6,655,988, issued on Dec. 2, 2003, discloses an LED module including module housing and terminals. The housing includes lead receiving channels in alignment with termination section of each of the terminals.

SUMMARY OF THE INVENTION

Accordingly, an object of the present invention is to provide a low-cost electrical connector.

In order to achieve the object set forth, the present invention provides an electrical connector including: an insulative housing including a mating face, a mating cavity extending through the mating face in a front-to-rear direction, and a pair of light receiving slots situated above the mating cavity and extending through the mating face in the front-to-rear direction; a pair of light emitting diodes (LEDs) each mounted in a corresponding light receiving slot, each LED having a lighting portion and a pair of leads extending rearwardly from the lighting portion in a horizontal direction; and an adapting terminal module including an insulative body mounted on a rear side of the insulative housing and four adapting terminals retained to the insulative body, each adapting terminal having a cooperating portion interference fit with the lead; wherein the cooperating portion is resiliently connected with the lead of the LED, the insulative body includes a retaining post, and the lead is retained between the retaining post and the cooperating portion.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
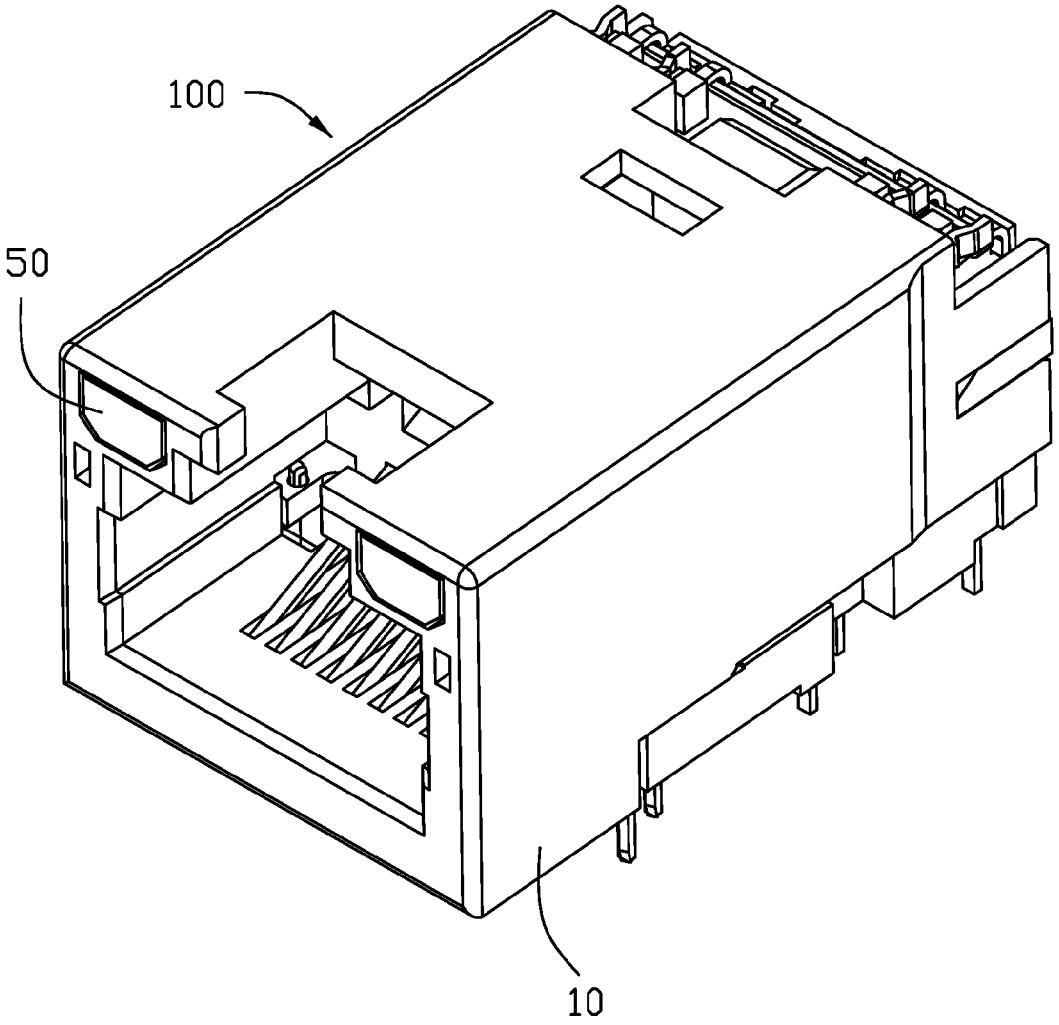
FIG. 1 is a perspective view of an electrical connector in accordance with the present invention.
Figure 2:
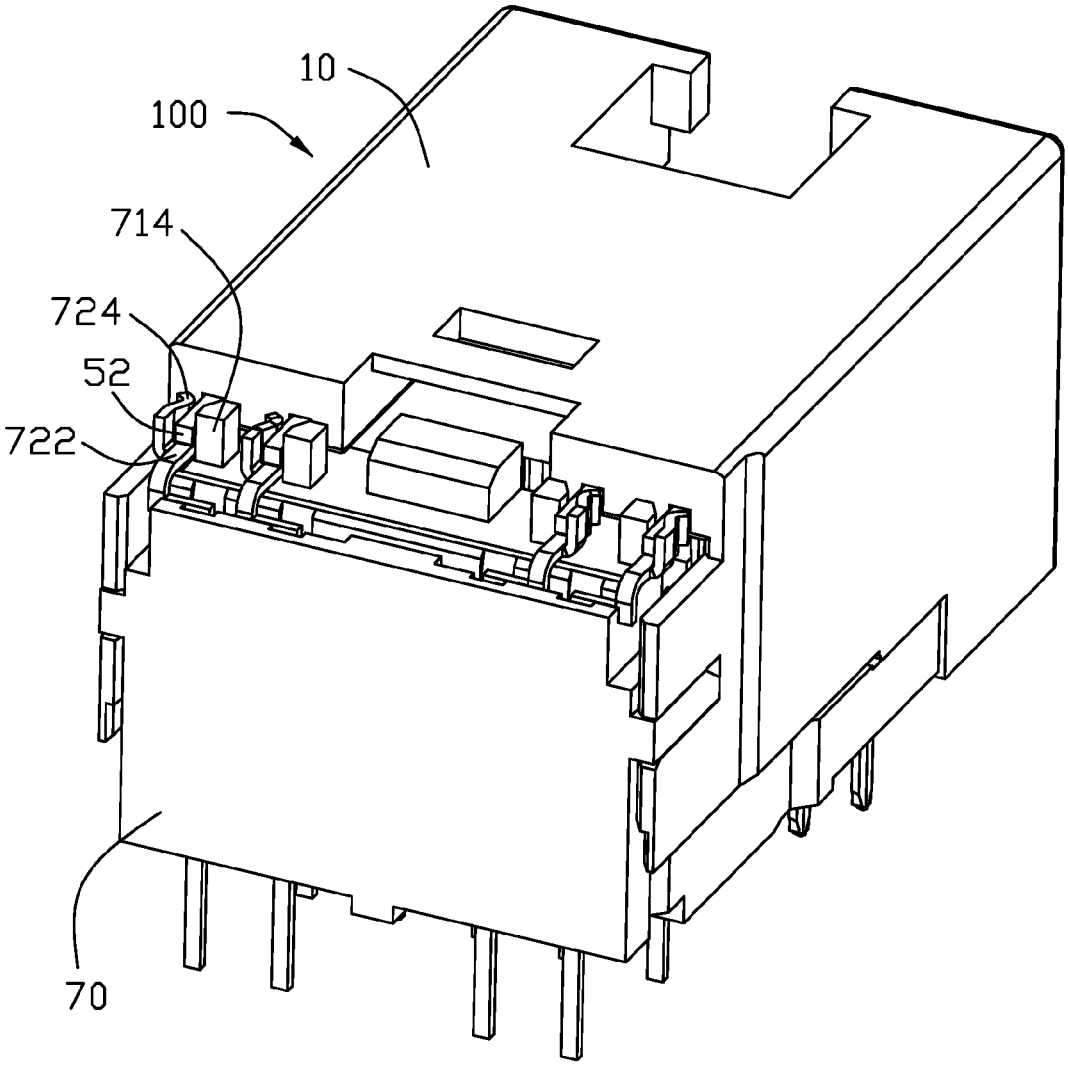
FIG. 2 is another perspective view of the electrical connector shown in FIG. 1.
Figure 3:
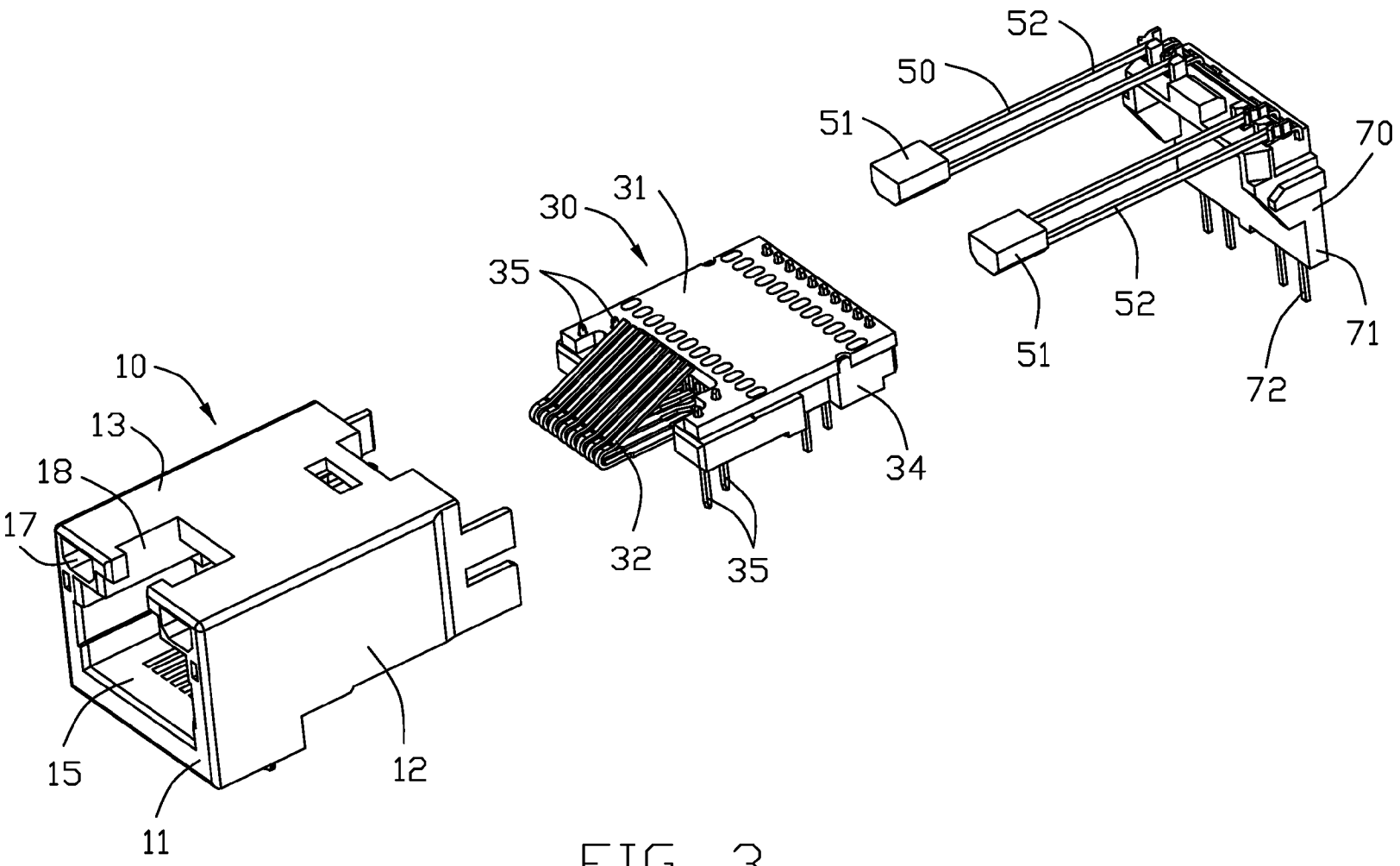
FIG. 3 is an exploded view of the electrical connector shown in FIG. 1.
Figure 4:
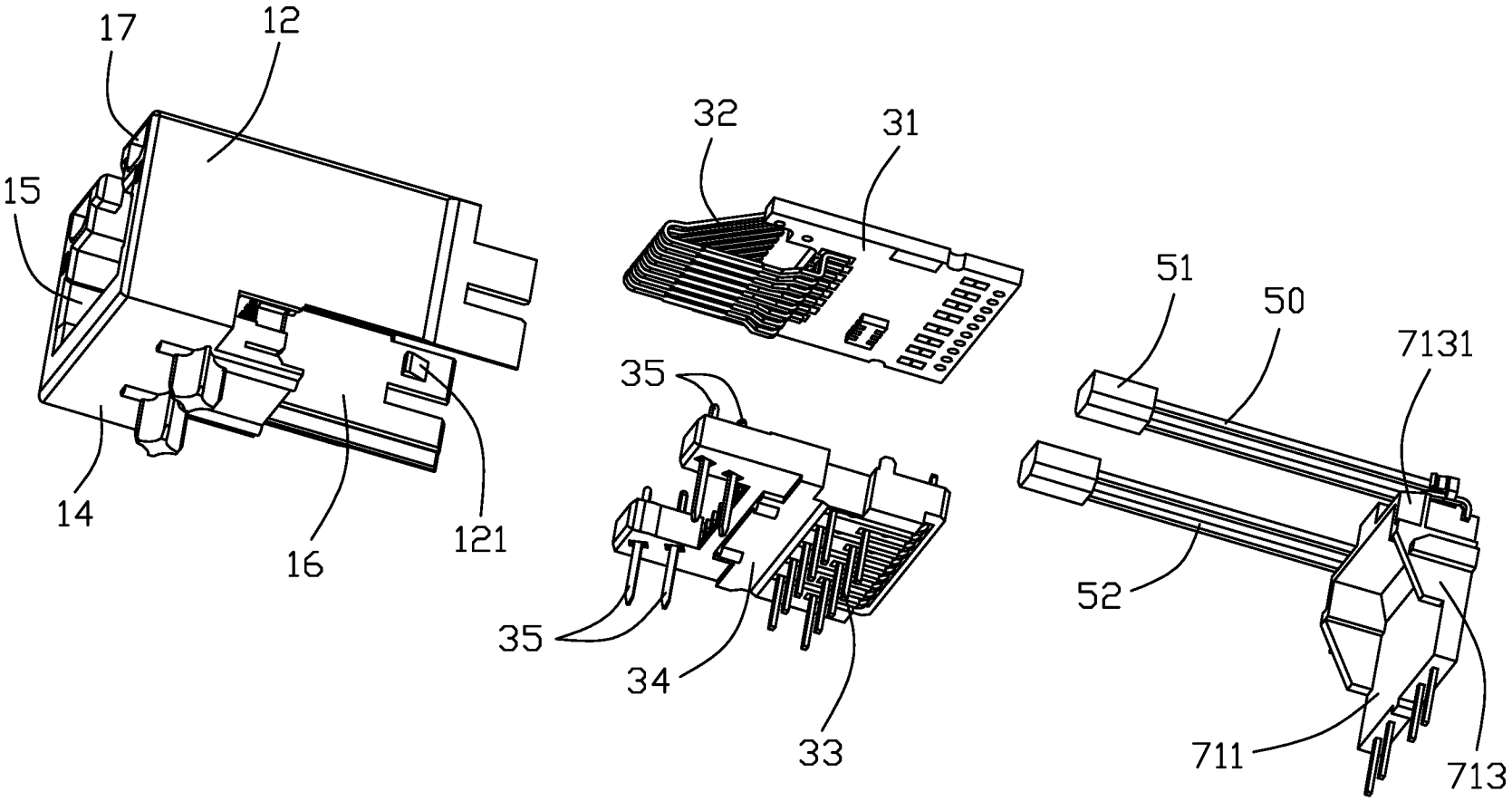
FIG. 4 is another exploded view of the electrical connector shown in FIG. 3.
Figure 5:
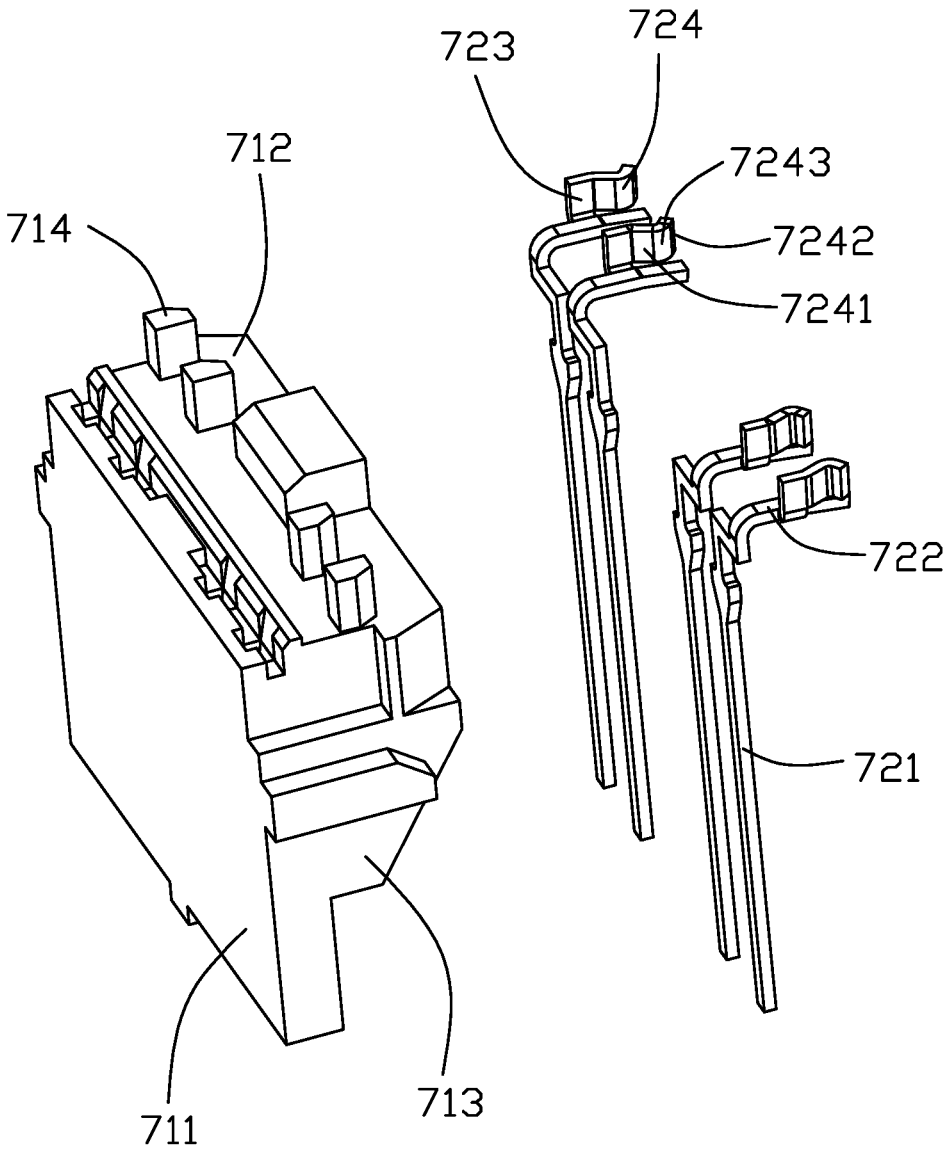
FIG. 5 is an exploded view of an adapting terminal module shown in FIG. 3.

Referring to FIGS. 1-5, an electrical connector 100 according to the present invention is shown. The electrical connector 100 adapted for being mounted on a mainboard (not shown), includes an insulative housing 10, a printed circuit board module 30, a pair of LED 50 and adapting terminal module 70.

The insulative housing 10 includes a mating face 11, a pair of side portions 12 extends rearwardly from opposite sides of the mating face 11, a top portion 13 connected with the pair of side portions 12, and a bottom portion 14 located opposite to the top portion 13. The pair of side portions 12, the top portion 13 and the bottom portion 14 jointly forms a mating cavity 15 and a mounting cavity 16 located behind of the mating cavity 15. The mating cavity 15 runs through the mating face 11 in a front-to-rear direction and communicating with the mounting cavity 16.

The insulative housing 10 further comprises a pair of light receiving slots 17 running through the mating face 11 in the front-to-rear direction and locking hole 18 running through the top portion 13 in an up-to-down direction. The locking hole 18 is communicate with the mating cavity 15, the light receiving slots 17 located above the mating cavity 15 and setting on a same height as the locking hole 18.

The printed circuit board module 30 mounted in the mounting cavity 16 from rear to front in the front-to-rear direction. The printed circuit board module 30 comprises a printed circuit board 31, a plurality of mating terminals 32 extending forwardly from printed circuit board 31 and protruding into the mating cavity 15, a plurality of mounting terminals 33 extending downwardly from the printed circuit board 31 and protruding beyond a bottom face 14 of the insulative housing 10. The printed circuit board module 30 further comprises a insulative support 34 held on a bottom side of the printed circuit board 31, a filter component (not shown) connecting with the mating terminal 32 and the mounting terminal 33, and four power terminals 35 setting on opposite sides of a front side of the printed circuit board 31. The filter component (not shown) can be a transformers, a common mode choke, a resistor, or a capacitor. The four power terminals 35 used for realizing universal power over ethernet (UPOE). The printed circuit board 31 setting flatly, the filter component (not shown) mounted on a top side or a bottom side of the printed circuit board 31.

The pair of LEDs 50 is attachably mounted in the corresponding light receiving slot 17 respectively which is located above the printed circuit board module 30. Each LED includes a lighting portion 51 and a pair of leads 52 extending rearwardly from the lighting portion 51. The lighting portion 51 is made of plastic material, and the two leads 52 are made of metallic conductive material.

The adapting terminal module 70 comprises an insulative body 71 mounted on a rear side of the insulative housing 10 and four adapting terminals 72 retaining in the insulative body 71. Each adapting terminal 72 includes a retaining portion 721 retained in the insulative body 71, a guiding contacting portion 722 extending forwardly from the retaining portion 721 in a horizontal direction, an adapting portion 723 extending upwardly from the guiding contacting portion 722, and a cooperating portion 724 extending rearwardly from the adapting portion 723. Preferably, the cooperating portion 724 is a cantilever having good flexibility. The cooperating portion 724 includes a first bending portion 7241 extending towards to the guiding contacting portion 722 extended from the adapting portion 723, a second bending portion 7242 extending away from the guiding contacting portion 722 extended from the first bending portion 7241, and a top contacting portion 7243 located at an intersection between the first bending portion 7241 and the second bending portion 7242. The second bending portion 7242 includes a free end 7245, and the top contacting portion 7243 is situated above the guiding contacting portion 722.

The cooperating portion 724 interference fits with the lead 52 of the LED 50, and the cooperating portion 724 has elastic and elastic connecting with the lead 52. Specifically, the top contacting portion 7243 is elastically connected with the lead 52, and the lead 52 of the LED 50 is located above the guiding contacting portion 722.

The insulative body 71 includes a vertical wall 711 extending in the up-to-down direction, a horizontal wall 712 extending forwardly in the front-to-rear direction, and a pair of side walls connecting 713 with the vertical wall 711 and the horizontal wall 712. The insulative body 71 includes a retaining post 714 extending upwardly from the horizontal wall 712, and the lead 52 is retained between the retaining post 714 and the cooperating portion 724. Each side portion 12 includes an inner locking block 121 located in the mounting cavity 16, each side wall 713 includes an outer locking block 7131 locking with the inner locking block 121. Thus, the insulative body 71 is retained with the insulative housing 10 reliably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

an insulative housing including a mating face, a mating cavity extending through the mating face in a front-to-rear direction, and a pair of light receiving slots situated around the mating cavity and extending through the mating face in the front-to-rear direction;

a pair of light emitting diodes (LEDs) each mounted in a corresponding light receiving slot, each LED having a lighting portion and a pair of leads extending rearwardly from the lighting portion in a horizontal direction; and an adapting terminal module including an insulative body mounted on a rear side of the insulative housing and four adapting terminals retained to the insulative body, each adapting terminal having a cooperating portion interference fit with the lead; wherein the cooperating portion is resiliently connected with the lead of the LED, the insulative body includes a retaining post, and the lead is retained between the retaining post and the cooperating portion, wherein each adapting terminal includes a retaining portion retaining in the insulative body, a guiding contacting portion extending forwardly from the retaining portion in the horizontal direction, and an adapting portion extending upwardly from the guiding contacting portion, and the cooperating portion extends from the adapting portion in a cantilevered manner.

2. The electrical connector as claimed in claim 1, wherein the cooperating portion includes a first bending portion extending towards the guiding contacting portion, a second bending portion extending away from the guiding contacting portion, and a top contacting portion located at an intersection between the first bending portion and the second bending portion, and the second bending portion includes a free end.

3. The electrical connector as claimed in claim 2, wherein the top contacting portion abuts against the lead of the LED elastically, and the lead of the LED is situated above the guiding contacting portion.

4. The electrical connector as claimed in claim 1, wherein the insulative body engages the insulative housing in a snap-fit manner.

5. The electrical connector as claimed in claim 4, wherein the insulative body includes a vertical wall extending in an up-to-down direction, a horizontal wall extending forwards in the front-to-rear direction, and a pair of side walls connecting with the vertical wall and the horizontal wall, and the retaining post extends upwardly from the horizontal wall.

6. The electrical connector as claimed in claim 5, wherein the insulative housing includes a pair of side portions, a top portion connecting the pair of side portions, and a bottom portion located opposite to the top portion, and the pair of side portions, the top portion, and the bottom portion jointly form the mating cavity and a mounting cavity located behind the mating cavity.

7. The electrical connector as claimed in claim 6, wherein each side portion includes an inner locking block located in the mounting cavity, each side wall includes an outer locking block locking with the inner locking block.

8. The electrical connector as claimed in claim 7, further comprising a printed circuit board module mounted in the mounting cavity, the printed circuit board module includes a printed circuit board, a plurality of mating terminals extending forwardly from the printed circuit board and protruding into the mating cavity, a plurality of mounting terminals extending downwardly and protruding beyond a bottom face of the insulative housing, and a filter component connecting with the mating terminal and the mounting terminal.

9. The electrical connector as claimed in claim 8, wherein the LED is located above the printed circuit board module.

10. An electrical connector comprising:

an insulative housing defining a mating cavity forwardly communicating with an exterior through a front mating face along a front-to-back direction;

a plurality of mating terminals extending into the mating cavity;

a receiving slot formed in the housing beside said mating cavity and forwardly extending through the front mating face;

a light emitting diode (LED) attachably received within the corresponding receiving slot, and including a front light portion exposed upon the mating face, and a rigid lead extending rearwardly from the light portion; and an adapting terminal having a resilient cooperating portion cooperating with an immovable insulative retaining post to sandwich the rigid lead therebetween in a transverse direction perpendicular to said front-to-back direction so as to form a mechanical and electrical connection between the rigid lead and the resilient cooperating portion, wherein said adapting terminal is retained in an insulative body to commonly form an adapting terminal module, said insulative body fixedly assembled to the housing, and said retaining post formed on the insulative body; wherein said adapting terminal includes a vertical retaining portion, a horizontal guiding contacting portion forwardly extending from a top end of the vertical retaining portion, an adapting portion extending upwardly from the guiding contacting portion in a vertical direction perpendicular to both said front-to-back direction and said transverse direction, and said cooperating portion extending from said adapting portion horizontally.

11. The electrical connector as claimed in claim 10, further including a printed circuit board on which the mating terminals are mounted, wherein said insulative body is located behind the printed circuit board in the front-to-back direction.

12. The electrical connector as claimed in claim 10, wherein all the retaining post, the cooperating portion and a rear end portion of the rigid lead are exposed rearwardly outside of the receiving slot for easy inspection.

13. The electrical connector as claimed in claim 10, wherein the cooperating portion and the retaining post form a pair of tapered surfaces opposite to each other for easy receiving the rigid lead therebetween.

14. An electrical connector comprising:

an insulative housing including a mating face, a mating cavity extending through the mating face in a front-to-rear direction, and a pair of light receiving slots situated around the mating cavity and extending through the mating face in the front-to-rear direction;

a pair of light emitting diodes (LEDs) each mounted in a corresponding light receiving slot, each LED having a lighting portion and a pair of leads extending rearwardly from the lighting portion in a horizontal direction; and an adapting terminal module including an insulative body mounted on a rear side of the insulative housing and four adapting terminals retained to the insulative body, each adapting terminal having a cooperating portion interference fit with the lead; wherein the cooperating portion is resiliently connected with the lead of the LED, the insulative body includes a retaining post, and the lead is retained between the retaining post and the cooperating portion; wherein the insulative body engages the insulative housing in a snap-fit manner; wherein the insulative body includes a vertical wall extending in an up-to-down direction, a horizontal wall extending forwards in the front-to-rear direction, and a pair of side walls connecting with the vertical wall and the horizontal wall, and the retaining post extends upwardly from the horizontal wall; wherein the insulative housing includes a pair of side portions, a top portion connecting the pair of side portions, and a bottom portion located opposite to the top portion, and the pair of side portions, the top portion, and the bottom portion jointly form the mating cavity and a mounting cavity located behind the mating cavity; wherein each side portion includes an inner locking block located in the mounting cavity, each side wall includes an outer locking block locking with the inner locking block.

15. The electrical connector as claimed in claim 14, further comprising a printed circuit board module mounted in the mounting cavity, the printed circuit board module includes a printed circuit board, a plurality of mating terminals extending forwardly from the printed circuit board and protruding into the mating cavity, a plurality of mounting terminals extending downwardly and protruding beyond a bottom face of the insulative housing, and a filter component connecting with the mating terminal and the mounting terminal.

16. The electrical connector as claimed in claim 15, wherein the LED is located above the printed circuit board module.

* * * * *